US006308978B1

(12) United States Patent
Kelman

(10) Patent No.: US 6,308,978 B1
(45) **Date of Patent: *Oct. 30, 2001**

(54) ATTACHMENT FOR A SNOWBOARD FOR LEARNING SNOWBOARD SKIING

(76) Inventor: Charles D. Kelman, 721 Fifth Ave., New York, NY (US) 10022

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/032,643

(22) Filed: Feb. 27, 1998

(51) Int. Cl.[7] ..... A63C 5/99

(52) U.S. Cl. ..... 280/608; 280/609; 280/809; 280/815; 280/14.21

(58) Field of Search ..... 280/14.2, 815, 280/608, 609, 814, 817, 809, 601, 14.21

(56) References Cited

U.S. PATENT DOCUMENTS

| | | | | |
|---|---|---|---|---|
| 2,242,156 | * | 5/1941 | Wallace | 280/601 |
| 3,820,802 | * | 6/1974 | Davis | 280/11.13 |
| 4,012,050 | * | 3/1977 | Miller | 280/11.38 |
| 4,974,868 | | 12/1990 | Morris | 280/609 |
| 5,312,258 | | 5/1994 | Giorgio | 434/253 |
| 5,462,304 | | 10/1995 | Nyman | 280/609 |
| 5,580,078 | | 12/1996 | Vance | 280/608 |
| 5,664,808 | | 9/1997 | Whidden et al. | 280/815 |

* cited by examiner

*Primary Examiner*—Eric Culbreth
*Assistant Examiner*—James S. McClellan

(57) ABSTRACT

A snowboard with a single lateral edge modified and/or a device for modifying a single lateral edge of a snowboard for the purpose of making the snowboard easier to control while learning to traverse snow covered slopes on the snowboard. A single edge of the snowboard is modified such that at least a portion of the edge is provided with a structure having a rounded profile of substantially larger radius of curvature than would result from merely rounding the sharp corners of the edge of the snowboard. The structure is positioned so that an arcuate surface is directed outwardly and downwardly from the edge. The structure of substantially larger radius of curvature can be provided in the form of permanent integrally formed swellings of portions of the snowboard edge, or could be provided by one or more removable members attached to the snowboard edge. The removable members are provided with a clearance which engages the edge, and fasteners to mount the member to the edge. Alternatively, the structure may embrace the edge of the snowboard with a friction fit sufficient to keep it mounted on the board in use. The surface of the structure preferably has a low coefficient of friction so that it slides easily in snow.

7 Claims, 2 Drawing Sheets

ATTACHMENT FOR A SNOWBOARD FOR LEARNING SNOWBOARD SKIING

BACKGROUND OF THE INVENTION

1. Field of the Invention

The present invention relates to boards for carrying people over snow, such as snowboards or snow skis, and more particularly pertains to edge structures for such boards, the edge structures provided to prevent a downhill edge from "catching".

2. Description of the Prior Art

The use of boards for carrying people over snow, such as snowboards and snow skis, is well known in the prior art. Although the text of this application is primarily directed to snowboards, it will be readily understood that the principles and structures of the present invention discussed herein are applicable to a variety of boards for traversing snow, such as snowboards and snow skis.

Known prior art snowboard and ski structures include U.S. Pat. Nos. 5,462,304, 5,580,078, 4,974,868, 4,778,710, 4,175,766, 4,951,960 and 3,751,054.

Generally, snowboards have an elongate shaped body with a tip portion, also known as a "nose" or "shovel", a central portion, which may also be referred to as a "waist", and an end portion, also known as a "tail", located, respectively, along a longitudinal axis. The snowboard has a slippery bottom surface, also known as a running surface, for contact with the snow. The running surface has opposite lateral edges substantially parallel with the longitudinal axis of the board. Each edge may have a slight sidecut, thus giving the snowboard a slightly hourglass shaped body when viewed from above. The running surface curves upwardly in at least the forwardmost portion of the nose, and in some board designs, at the rearwardmost portion of the tail. The running surface may also have a slight arch from the tall to the nose along the longitudinal axis. A top surface, also known as the "deck", is provided to support a rider. Bindings on the deck in the central portion of the board secure the rider to the board. The bindings are provided such that the rider stands substantially sideways on the board with his feet skewed somewhat towards the nose of the board.

The basic dimensions of a snowboard are determined by several main factors. The central portion of a snowboard must generally be wide enough to accommodate the substantially perpendicularly positioned feet of a rider, without toes and/or heels extending beyond the edges of the deck to drag in the snow and negatively affect the performance of the snowboard. To facilitate turning and control of the snowboard, the nose and tail are generally slightly wider than the central portion of the board, thus giving the snowboard the hourglass shape. The slightly broader dimension of the nose and tail portions significantly increases the rider's ability to control the direction of travel of the board by facilitating turns.

The above design parameters, in particular, the central portion which is wide enough to accommodate the perpendicularly positioned feet of the rider, and the slightly wider nose and tail to facilitate turning, result in a broad running surface. A broad running surface permits the snowboard to slide quickly over slippery surfaces, such as snow or ice, particularly with the weight of a rider on the deck of the snowboard, and particularly on inclined snow surfaces. When substantial portions of the running surface are in contact with the snow surface, such as, for example, when the running surface is flat on the snow surface, the snowboard tends to slide more quickly, and with less control. Control of a snowboard sliding on snow is accomplished by using the edges of the running surface to stop and turn the snowboard. Turning the snowboard controls the speed and direction of travel of the snowboard. In particular, a skilled snowboard rider controls the speed and direction of travel of the snowboard by "carving" turns in the snow. This is accomplished by the rider shifting his weight on the snowboard such that one lateral edge of the running surface "digs in" to the snow, and, correspondingly, the opposite lateral edge is lifted from the snow, and less of the running surface contacts the snow surface. The lateral edge of the snowboard that "digs in" will hereinafter be referred to as the "carving edge". Generally speaking, the "carving edge" is the lateral edge of the running surface relatively closest to the top of the incline being traversed, also known as the "uphill edge" of the running surface.

A snowboard can be slowed by reducing the running surface in contact with the snow, and/or by traversing across the fall line of a slope rather than down the fall line. The fall line of a slope is the most direct route down the slope. Conversely, the speed of the snowboard can be increased by increasing the running surface in contact with the snow, and/or by traveling along the fall line of the slope. Thus, the speed of the board can be controlled by controlling the amount of running surface in contact with the snow, and by controlling the direction of travel relative to the fall line of the slope. By carving turns with the carving edge of the running surface, a rider can control both his speed and direction by, for example, reducing the apparent steepness of his path of travel on a slope, i.e., by steering the snowboard across the fall line of the slope, or even by steering the snowboard up the slope. Carving turns is therefore critical to the control of the snowboard. The edges of the running surface are in turn critical to carving turns. Other design features of the snowboard, such as the slight arch of the running surface, the flexibility or stiffness of the snowboard, and the slight hourglass shape of the snowboard also contribute to control of the snowboard. A skilled rider on a properly designed snowboard can carve turns to precisely control the speed and direction of travel of the board.

However, for a person first learning to ride a snowboard, i.e., a novice, the concept of carving a turn is a skill that must be learned by practice. Unfortunately for a beginning snowboard rider, the broad running surface of the snowboard, and the tendency of gravity to act on a weight capable of sliding, can quickly cause a novice to careen out of control on even a slight incline. Furthermore, while learning to carve a turn by digging in the carving edge, i.e., the uphill edge, of the running surface, novices frequently lose their balance or otherwise cause the wrong edge of the running surface, i.e., the "downhill edge" or "free edge" (generally the lateral edge of the running surface relatively closer to the bottom of the incline being traversed) to dig in. Digging in the downhill edge of the running surface is known as "catching an edge". Catching an edge may cause the snowboard to stall or stop. The snowboard rider, particularly the novice, tends to lose control of the board and, typically, will fall. Novice riders typically "catch an edge" numerous times before they master the skill of carving a turn with the uphill edge of the running surface. The resulting frequent falls associated with catching an edge can cause a novice great discomfort in the form of pain due to injuries and exhaustion due to the effort required to recover from the falls. Furthermore, serious injury can result from the falls.

Thus, the most important skill in snowboarding, i.e., carving a turn, is also one of the most difficult skills to master due to the tendency of the novice snowboard rider to catch an edge and fall.

U.S. Pat. No. 5,462,304 to Nyman addresses the problem of catching an edge by permanently modifying both lateral edges of the running surface such that each lateral edge has a first inward facing edge, and a second elevated outward facing edge. A downwardly and outwardly directed sloping side surface angles upward from the first edge to the second edge, connecting the two edges. The second elevated outward facing edge is positioned with sufficient height relative to the running surface that the outward facing edge does not "catch". The downwardly and outwardly directed sloping surface connecting the first inward facing edge and the second outward facing edge is sufficiently angled that it also does not "catch". However, the board as disclosed and claimed by Nyman has several drawbacks. The permanent and rather radical modifications to both edges of the snowboard as taught by Nyman would be difficult to maintain due to the complex cross-sectional shape of each edge. Furthermore, the edges as taught by Nyman occupy portions of the running surface of the snowboard that are flat on a conventional snowboard. Thus, compared to a conventional snowboard, the edges as taught by Nyman reduce the width of the flat portion of the running surface, i.e., the surface that provides speed to the snowboard, thus slowing the board. Furthermore, the edges as taught by Nyman eliminate the ability of the board to slide laterally when such a slide is desired, thus reducing the maneuverability of such a board. In addition, since "catching an edge" is typically only a major problem for novice snowboard riders, as a rider's skills increase, the rider will rapidly outgrow a board made according to the teaching of Nyman. Most importantly, since Nyman teaches permanently modifying the carving edge and the free edge of a snowboard, it may not be possible for a novice rider learning to carve turns on a snowboard with the edges modified according to Nyman to learn how to carve a turn on a snowboard having conventional style running surface edges. A novice rider learning on a snowboard with a carving edge modified according to the teachings of Nyman would only learn to carve turns on edges modified according to Nyman and, therefore, may not be suitably skilled to make a transition to a snowboard having a conventional edge.

U.S. Pat. No. 5,644,808 to Whidden et al. is directed to an edge covering for a ski or snowboard. The edge covering is an elongated cylindrical channel which frictionally engages the edge of a ski or snowboard. The disclosure of Whidden et al. teaches that the edge covering is for protecting the edges of the ski or snowboard from unintentional engagement with surrounding objects. The specification does not teach or suggest that the edge covering can be in place on the ski or snowboard when the ski or snowboard is actively being used by a rider. As depicted in the drawings, the edge covering is applied to both lateral edges, and to the tip of the ski or snowboard. According to the specification, the edge of the tail may also be covered. As shown in the drawings, the edge covering taught by Whidden et al. would render the ski or snowboard useless for riding purposes because the edge covering provided on both lateral edges would prevent the user from carving turns. An attempt to use the ski or snowboard with the edge cover as taught by Whidden et al. in place would, due to the users inability to carve a turn, likely result in injury to the user.

In view of the foregoing disadvantages, there is a need for novices learning to ride a snowboard, for a snowboard modified to facilitate control and stability of the snowboard by preventing the stalls and falls caused by a downhill edge catching.

SUMMARY OF THE INVENTION

The present invention is directed to a modified downhill or free edge of a snowboard and/or a device for modifying the downhill or free edge of a snowboard. According to the present invention, the downhill or free edge of the snowboard is modified such that at least a portion of the free edge is provided with a structure having a rounded profile of substantially larger radius of curvature than would result from merely rounding the sharp corners of the edge of the snowboard. The structure of substantially larger radius of curvature could be provided in the form of permanent integral swellings of portions of the snowboard free edge, or could be provided by one or more removable members attached to the snowboard free edge. The surface of the structure has a low coefficient of friction so that it slides easily in snow. The structure could be provided in the form of a length of rubber or plastic hose, such as, for example, teflon, which is slit longitudinally, so as to fit over and embrace at least a portion of the downhill or free edge of the snowboard. The structure could be integrally molded with the snowboard, or could be permanently or removably attached with conventional fasteners, such as, for example, screws, rivets, clips or glue. Alternatively, the structure may embrace the edge of the snowboard with a friction fit sufficient to keep it mounted on the board in use.

It is therefore an object of the present invention to provide a structure for the downhill or free edge of a snowboard which will prevent that edge from catching.

It is another object of the invention to provide a removable structure for the downhill or free edge of a snowboard which will cover at least portions of the sharp free edge and instead present a smooth curved surface to the snow.

It is another object of the present invention to provide a snowboard with an integral structure for the downhill or free edge of a snowboard which will prevent the edge from catching.

It is another object of the invention to provide a structure for the downhill or free edge of a snowboard, the structure being universally mountable on many different types of snowboard.

It is another object of the invention to provide a structure for selectively mounting to either lateral edge of a snowboard, the selectively mounted structure preventing the edge that it is mounted to from catching.

BRIEF DESCRIPTION OF THE DRAWINGS

The foregoing and other features and advantages of the present invention will be more readily appreciated and understood from the detailed description when taken in conjunction with the following drawings, wherein.

DETAILED DESCRIPTION OF THE PREFERRED EMBODIMENT

Figure 1:
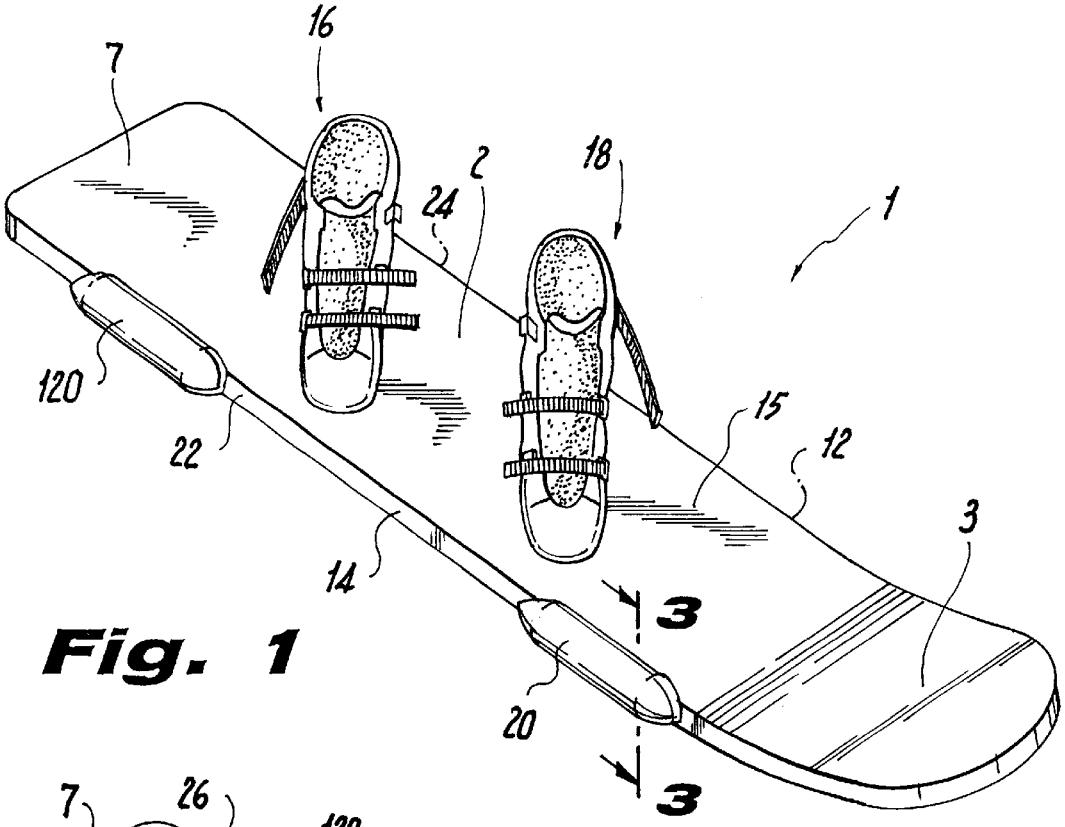
FIG. 1 is a top-front-left perspective view of a snowboard with structures according to the present invention to prevent a downhill or free edge catching.
Figure 2:
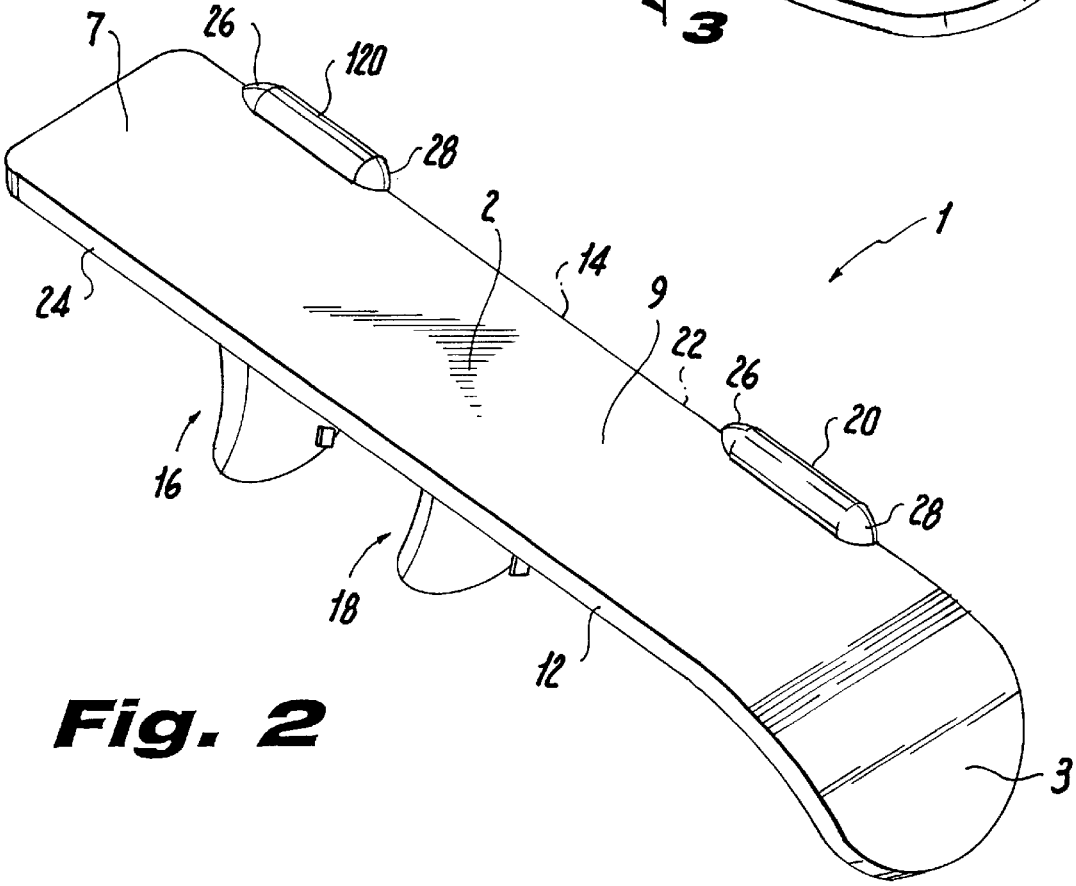
FIG. 2 is a bottom-front-right side perspective view of the snowboard in FIG. 1 with structures to prevent edge from catching.

Referring to FIGS. 1 and 2, a snowboard is shown generally at 1 having an elongate shaped body 2 with nose 3, a central portion or waist 5, and a tail 7, located, respectively, along a longitudinal axis. The snowboard has a slippery bottom running surface 9, for contact with the snow. A top surface or deck 15, is provided to support a rider. The running surface 9 and the top surface 15 are connected along peripheral edges by sidewalls which, along the lateral sides of the snowboard body form lateral peripheral surfaces 22, 24. Bindings 16, 18 on the deck 15 in the central portion 5 of the board 1 secure the rider to the board. The bindings 16, 18 are provided such that the rider stands substantially sideways on the board with his feet skewed somewhat towards the nose 3 of the board. The bindings can be provided such that the rider stands on the board with the left foot or the right foot closer to the nose of the board.

The running surface 9 has opposite lateral running surface edges 12 and 14, respectively defined at the intersection of the periphery of the running surface 9 and the lateral peripheral surfaces 22, 24 of the snowboard body sidewalls. The edge 12 or 14 of the running surface 9 which is proximal to the toes of the rider, is known as the "toe-edge" of the snowboard. The edge 12 or 14 of the running surface 9 which is proximal to the heels of the rider is known as the "heel edge" of the snowboard. The running surface edges 12, 14 are substantially parallel with the longitudinal axis of the board 1, but each edge may have a slight sidecut in the vicinity of the central portion 5 of the board 1, thus giving the snowboard a slightly hourglass shaped body 2 when viewed from above. The running surface 9 curves upwardly in at least the forward most portion of the nose 3, and in some board designs, at the rearwardmost portion (not shown) of the tail 7. The running surface 9 may also have a slight arch (not shown) from the tail 7 to the nose 3 along the longitudinal axis.

At least one shaped member 20 is attached to the free edge, which for exemplary purposes is edge 14, of the snowboard 1 such that at least a portion of the edge 14 of the running surface 9 resists "digging in" to the snow. Preferably, one or more shaped members 20, 120 are attached to the board such that substantially all of the edge 14 resists "digging in" to the snow. This may be accomplished by providing one shaped member 20 which covers substantially all of edge 14 from the nose 3 to the tail 7 of the snowboard 1. Alternatively, two or more relatively short shaped members 20, 120 can be suitably attached to the snowboard along the edge 14 such that substantially all of the edge 14 resists "digging in" to the snow. It will be readily understood that the degree to which each individual shaped member prevents an edge from digging in depends on the cross-sectional shape of the member, the shape of the body of the member, its ability to slide in snow, its thickness relative to the board thickness, and snow conditions, as well as other design parameters.

For example, the member 20 may be cylindrically shaped, with tapered ends 26, 28 and a smooth surface to present a low coefficient of drag and thus facilitate sliding on or through snow. Although the member 20 is illustrated and described as a torpedo-shaped member, it will be readily understood that other shapes would be suitable for serving the same purpose. For example, spherical or ovoid shaped members would also work. As noted above, the shaped member 20 may extend along the entire length of the edge 14, or may, as illustrated, extend along only a portion of the edge 14. In the latter case, a second shaped member 120 may be attached to a second portion of edge 14. In fact, any number of shaped members could be attached to the edge 14 for the purpose of rendering all of edge 14, or selected portions of edge 14 unable to "dig in".

Figure 3:
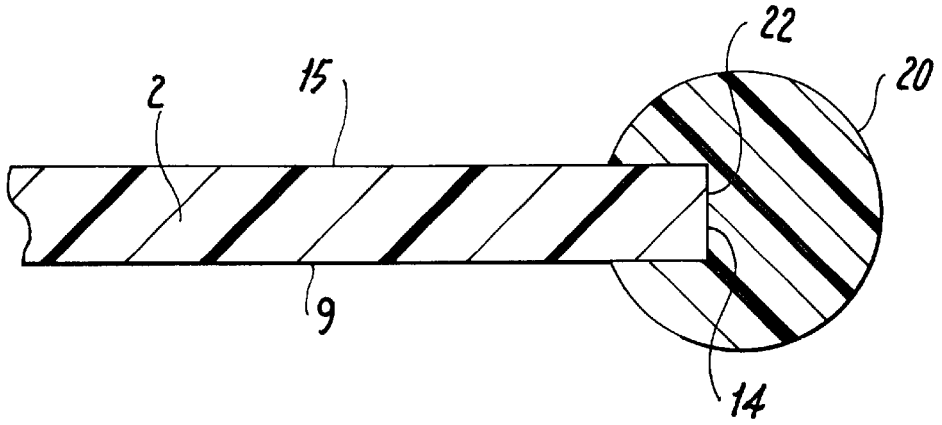
FIG. 3 is a cross-sectional view taken along line 3—3 showing a removable member for preventing edge catching having a solid body.
Figure 4:
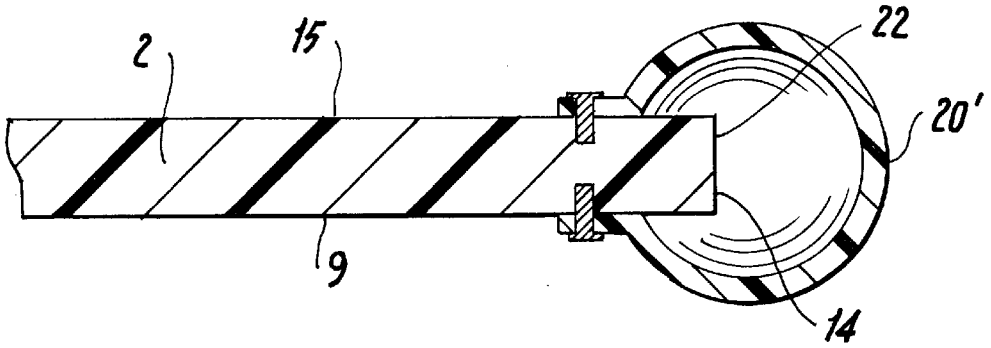
FIG. 4 is a cross-sectional view taken along line 3—3 showing a removable member for preventing edge catching having a hollow body.
Figure 5:
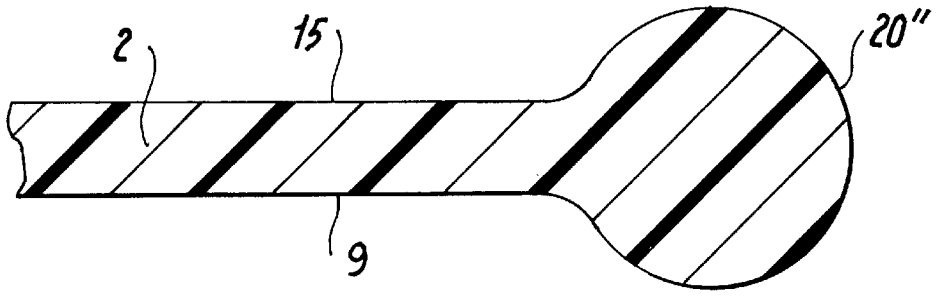
FIG. 5 is a cross-sectional view taken along line 3—3 showing a structure for preventing edge catching integrally molded into the snowboard.

The cross-sectional shape of the member 20, 120 as depicted in FIGS. 3–5 is preferably circular, and preferably has a substantially larger radius of curvature than would result from merely rounding the sharp corners of the existing edge. The members 20, 120 provide a rounded edge to the normally squared off edge of a snowboard.

In use, the shaped member serves as a training aid, preventing the downhill or free edge 14 of the running surface 9 from digging in to snow and "catching". In training, novice snowboard riders generally learn to carve turns with a single carving edge the snowboard. As their skill level increases, the rider may learn to use both edges. A skilled rider, i.e., a rider that uses both edges 12, 14, would have little use for a training aid according to the present invention, since a skilled rider, in the course of descending a slope will often switch from one running surface edge to the other running surface edge, i.e. reversing the carving and free edge.

It is important to point out that the shaped member or members according to the present invention are attached only to one lateral edge 12 or 14 of the running surface 9 of the snowboard. At least one running surface edge must be kept free of shaped members so that the snowboard user can carve turns.

The shaped members 20, 120 are attached to the snowboard such that the member embraces the edge of the snowboard and partially overlaps at least the running surface and the sidewall of the snowboard, such that a convex arcuate shaped portion of the cross-section of the shaped member is spaced apart from the running surface edge of the snowboard. Alternatively, the arcuate surface of the shaped member may be adapted to engage the running surface edge such that there is a smooth transition from the shaped member to the running surface edge. The smooth transition can be provided vertically relative to the edge of the snowboard, such that the arcuate surface extends down and inwardly from the running surface edge. Alternatively, the smooth transition can be provided horizontally, such that the arcuate surface extends up and outwardly from the running surface edge. In any case, the convex arcuate shaped portion of the cross-section of the shaped member must be substantially greater in height than the thickness of the snowboard as measured from the top surface to the running surface. Furthermore, the lowest point of the convex arcuate shaped portion of the cross-section of the shaped member must not be higher than the lowest point of the running surface edge of the snowboard. The substantial difference in dimension of the shaped member and the snowboard edge, combined with the arcuate cross-section of the shaped member, allows the member to carry the free edge of the snowboard up over the snow surface, preventing the free edge from digging in, and preventing the snowboard from catching an edge.

In the preferred embodiment of the present invention, the shaped members 20, 120 are easily mountable and demountable to the either edge of the snowboard. This provides several advantages. While a novice is learning the skills necessary to carve turns with either the toe edge or the heel edge of the snowboard, it is convenient for the user to be able to switch the shaped members 20, 120 from a free edge to an opposite carving edge.

For example, when a user desires to practice carving turns with a toe edge, the shaped members are mounted on the heel edge, which corresponds to the free edge. If the user desires to practice carving turns with the heel edge, the shaped members 20, 120 are demounted from the heel edge and mounted on the toe edge, which now corresponds to the free edge.

Another advantage of providing easily mountable and demountable shaped members is that the members can be attached to any snowboard having a conventional running surface edge. Thus, in a situation where a variety of users may use the same board, such as, for example, at a snowboard riding school where equipment is typically rented to novice as well as skilled users, the shaped members can be mounted or demounted to suit the needs of the user of the moment. Also, various shapes, lengths and numbers of shaped members can be selectively mounted or demounted to suit a variety of rider sizes and weights, or to suit a variety of snow and terrain conditions. In a situation where a rider owns a snowboard, after the rider has gained sufficient skill, the removable shaped members 20, 120 may be demounted and the snowboard used in the conventional manner. Thus, the rider is not forced to purchase a new snowboard which corresponds to his higher skill level.

Alternatively, the shaped member may be permanently mounted or integrally molded onto one edge of a snowboard. The shaped member could only be permanently provided on one edge, so that a the snowboard has at least one carving edge to accommodate turning. This construction would provide a dedicated training snowboard with a fixed carving edge and a fixed free edge. In order to learn carving on opposite heel and toe edges, the user would be required to reverse the direction of the bindings on the board, or switch to a second board with bindings provided in the opposite direction.

The shaped members can be made of any suitable material, such as, for example, plastic, glass reinforced plastic, wood, metal, etc. The shaped member or members can be removably mounted with any conventional mounting means, such as, for example, screws, pins, etc. Alternatively, the shaped member or members can be permanently attached to the snowboard by any conventional means, such as, for example, screws, rivets, adhesive, welding, etc. The shaped members may be solid or hollow.

While the preferred embodiments of the invention have been illustrated and described, it will be appreciated that various changes can be made to therein without departing from the spirit and scope of the invention as claimed below.

What is claimed:

1. A training aid for attachment to a snowboard such that the snowboard is usable to traverse a snow covered surface, the snowboard having a board body defined by a first and a second end connected along a longitudinal axis, a top surface adapted to support a snowboard rider, a bottom defining a running surface for contacting snow, a first lateral side and a second lateral side opposite the first lateral side, each connecting the top surface to the running surface, the running surface and the first lateral side intersecting at an angle to define a carving edge, the running surface and the second lateral side intersecting to define a free edge, the board body having a thickness, the training aid comprising:

a shaped member having opposite tapered ends, a portion of the member between the tapered ends defining a convexly arcuate surface extending through a thickness greater than the thickness of the board body, the convexly arcuate surface terminating at a clearance in the member dimensioned to receive a portion of the second lateral side of the board body in mating engagement such that the convexly arcuate surface is directed outwardly and downwardly relative to the free edge, and such that the convexly arcuate surface is contiguous with or overlaps a portion of the free edge;

wherein each of the tapered ends is adapted to form a transition along the longitudinal axis between the arcuate surface and the board body;

wherein the training aid prevents the free edge from catching in the snow covered surface; and means for securing the training aid to the board body to prevent the training aid from disengaging from the board body during operation.

2. The training aid of claim 1 wherein the convexly arcuate surface forms a smooth transition with the running surface of the snowboard.

3. The training aid of claim 1 wherein the convexly arcuate surface forms a smooth transition with the second lateral side of the snowboard extending upwardly from the free edge.

4. The training aid of claim 1 wherein the shaped member is rod-shaped and has a first and a second end, and at least one of the first and the second end is tapered.

5. A method of preventing a free edge of a snowboard from catching a snow surface while the snowboard is used for traversing the snow surface, the snowboard having a board body defined by a first and a second end connected along a longitudinal axis, a top surface adapted to support a snowboard rider, a bottom defining a running surface for contacting the snow surface, a first lateral side and a second lateral side each connecting the top surface to the running surface, the running surface and the first lateral side intersecting at an angle to define a carving edge, the running surface and the second lateral side intersecting to define the free edge, the board body having a thickness, the method comprising:

providing an outwardly and downwardly directed convexly arcuate surface to at least a portion of the second lateral side of the board in a manner to prevent disengagement of the convexly arcuate surface from the board during operation, the convexly arcuate surface extending through a thickness substantially greater than the thickness of the board body, the convexly arcuate surface positioned on the second lateral side such that the convexly arcuate surface is directed outwardly and downwardly from the free edge, the convexly arcuate surface having opposite ends each adapted to form a tapered transition along the longitudinal axis from the convexly arcuate surface to the board body.

6. A snowboard for training snowboard riders, comprising:

a body having a first and a second end connected along a longitudinal axis, a top surface adapted to support a snowboard rider, a bottom defining a running surface for contacting a snow surface, a distance between the top surface and the running surface defining a thickness of the body, a first lateral side and a second lateral side opposite the first lateral side, each connecting the top surface to the running surface, the first lateral side and the running surface intersecting at an angle to define a carving edge for carving turns, the running surface and the second lateral side intersecting to define a free edge, and a part provided along a portion of a length of the second lateral side, the part having a thickness greater than the thickness of the body, the part defining a convexly arcuate surface, the convexly arcuate surface directed outwardly and downwardly relative to the free edge.

7. A shaped member for attachment to a snowboard, the snowboard having a first and a second end connected along a longitudinal axis, a running surface for contacting snow and a top surface for supporting the rider, a lateral peripheral surface between the top surface and the running surface, the lateral peripheral surface and the running surface defining at their intersection on opposite sides of the snowboard a pair of relatively sharp running surface edges, the shaped member comprising:

means for removable attachment to the snowboard along one of the running surface edges to prevent disengagement during operation;

main body having a generally smooth outer surface of convexly arcuate cross-sectional shape directed outwardly and downwardly relative to the one of the running surface edges for covering at least a portion of said one of the running surface edge, so as to prevent said portion of said one of the running surface edges from coming into catching contact with the snow; and opposite ends each adapted to form a tapered transition between the main body and the board body.

* * * * *